United States Patent [19]

Harvey

[11] Patent Number: 4,607,801

[45] Date of Patent: Aug. 26, 1986

[54] PULVERIZING MILL

[76] Inventor: Phillip R. Harvey, 305 South Rd., Mile End South, Australia

[21] Appl. No.: 624,616

[22] Filed: Jun. 26, 1984

[30] Foreign Application Priority Data

Jun. 27, 1983 [AU] Australia ..... PG0007

[51] Int. Cl.[4] ..... B02C 17/14

[52] U.S. Cl. ..... 241/199.1; 241/175; 241/300

[58] Field of Search ..... 241/175, 285 B, 179, 241/184, 285 R, 199.1–199.8, 207–216, 300; 51/163.2

[56] References Cited

U.S. PATENT DOCUMENTS

| | | | |
|---|---|---|---|
| 1,993,900 | 3/1935 | Rumpel | 241/215 |
| 3,138,337 | 6/1964 | Bogot et al. | 241/300 X |
| 3,464,674 | 9/1969 | Pick | 241/175 X |
| 3,514,907 | 6/1970 | Strom | 241/175 X |
| 4,043,514 | 8/1977 | Peterson, Jr. | 241/285 B X |

*Primary Examiner*—Mark Rosenbaum

*Attorney, Agent, or Firm*—Wm. T. Wofford; James C. Fails; Arthur F. Zobal

[57] ABSTRACT

A pulverizing mill comprising a fixed base frame, a vibrating frame, support coil springs interconnecting the base frame and the vibrating frame for resiliently supporting the latter, aligned bearings carried in the vibrating frame and journalling respective upper and intermediate portions of a driven shaft which depends centrally through the vibrating frame, an eccentric weight carried by the shaft for providing the motive force to cause vibratory movement, a container or bowl having a replaceable wear base plate, being removably secured to the vibrating frame and containing pulverizing metal masses, and an hydraulic motor attached to the lower end of the vibrating frame and having its drive shaft coupled by flexible coupling means to the lower end of said driven shaft.

11 Claims, 3 Drawing Figures

PULVERIZING MILL

Figure 1:
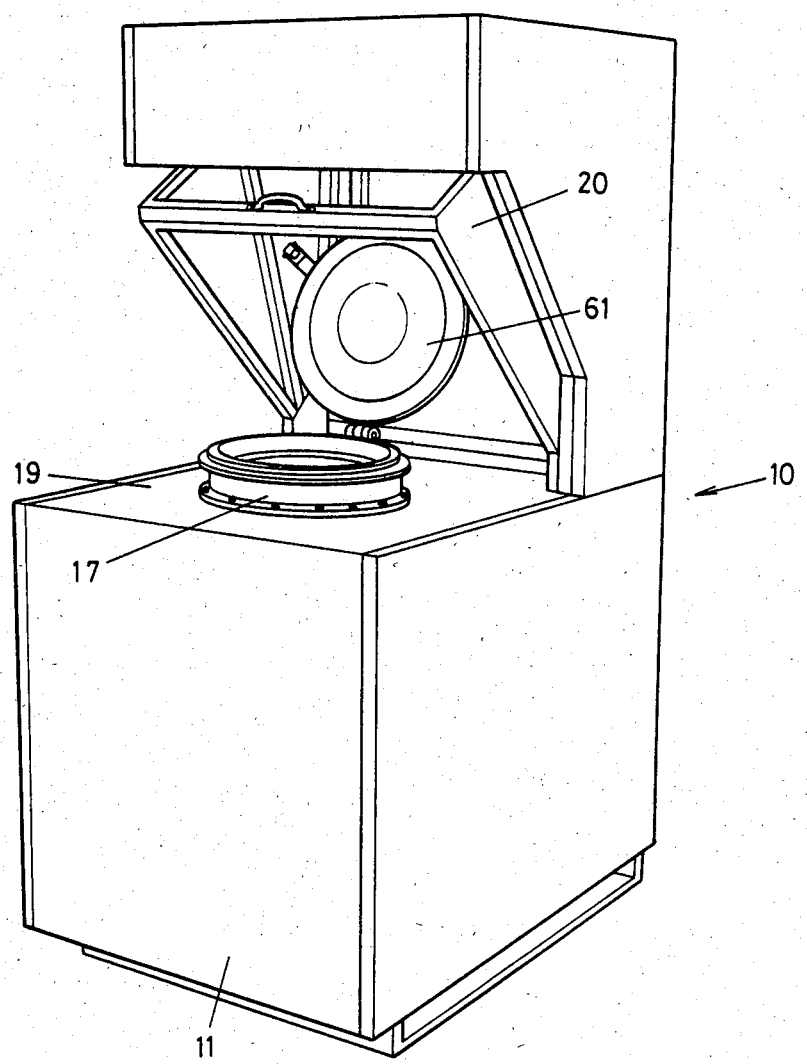

This invention relates to a pulverising mill of the eccentric weight type commonly used in geological sampling.

When it is desired to obtain a sample of rock and analyse that sample for existence of valuable minerals, the rock is usually divided into a number of smaller portions and normally one of these is pulverised in a pulverising mill, by being contained within a container having a base, side walls and a hinged lid, the pulverising being effected by the movement, under centrifugal force, of at least one pulverising member, the most common arrangement being to have an annular ring itself containing a cylindrical block of metal, both being of considerable mass and being of hard metal. The container and the pulverising ring and disc are moved in an orbital manner, by being supported from a base frame with support springs, and having a vibrating frame depending from the container which had on it a disc or arm carried by a shaft journalled in bearings for rotation, the disc or arm however having an eccentric weight such that when driven by an electric motor coupled to the shaft, the eccentric weight movement providing the motive force to produce the orbital movement which in turn causes the pulverising effect to be achieved.

A number of disadvantages however are associated with this arrangement.

In the first instance, the prior art machines do not have the capacity to handle large samples and the geological sample is likely to be so small that it is not representative of the original sample, that is, with respect to its mineral composition.

Secondly, the inertia of the electric motor is such as to inhibit the orbital movement, imposing additional loading on the bearings and additional power consumption on the motor. To reduce this problem experiments have been conducted utilising a larger electric motor driving a large container, big enough to contain a representative sample without the requirement of subsequent mixing which can be inaccurate, and the motor was itself ball mounted and coupled to the eccentrically weighted shaft by an elongate coupling shaft, but even this arrangement failed to give sufficient freedom of movement to the orbiting mass.

Thirdly, the prior art machines are generally unsatisfactory from the point of view of maintenance and replacement costs in that they include numerous moving parts which are prone to wear.

The main object of this invention is to provide improvements whereby the long-felt needs defined above can be at least partly satisfied, and according to this invention, there is provided a pulverising mill comprising a fixed base frame, a vibrating frame, support coil springs interconnecting said base frame and said vibrating frame for resiliently supporting the latter, said springs being spaced around said vibrating frame, a pair of vertically spaced aligned bearing means carried in the vibrating frame, a vertical, driven shaft having its upper end and an intermediate portion thereof respectively journalled in said bearing means, said shaft extending centrally through said vibrating frame, an eccentric weight or mass carried by said shaft for rotation therewith inside of said vibrating frame, said weight or mass being secured to the shaft between said pair of spaced bearing means, a pulveriser bowl or container centrally supported on said vibrating frame for vibratory movement therewith, and an hydraulic motor attached to said vibrating frame and having its drive shaft coupled by flexible coupling means to the lower end of said driven shaft.

By utilising an hydraulic motor, the mass imparted by the orbiting portion of the mechanism is much less than if an electric motor is used.

In a preferred arrangement, the vibrating frame comprises an upper cylindrical housing and removably attached thereto, a co-axial lower cylindrical housing of smaller diameter than said upper housing, said upper housing defining a chamber housing said eccentric weight and the upper one of said bearing means, said lower housing defining a chamber which houses said flexible coupling means and the lower one of said bearing means.

With this invention, it is possible to pulverise a sufficient quantity of the sample at any one time to ensure a homogeneous mixture of particulate material after pulverising has taken place, and thereby improve the quality of any subsequent analysis.

Figure 2:
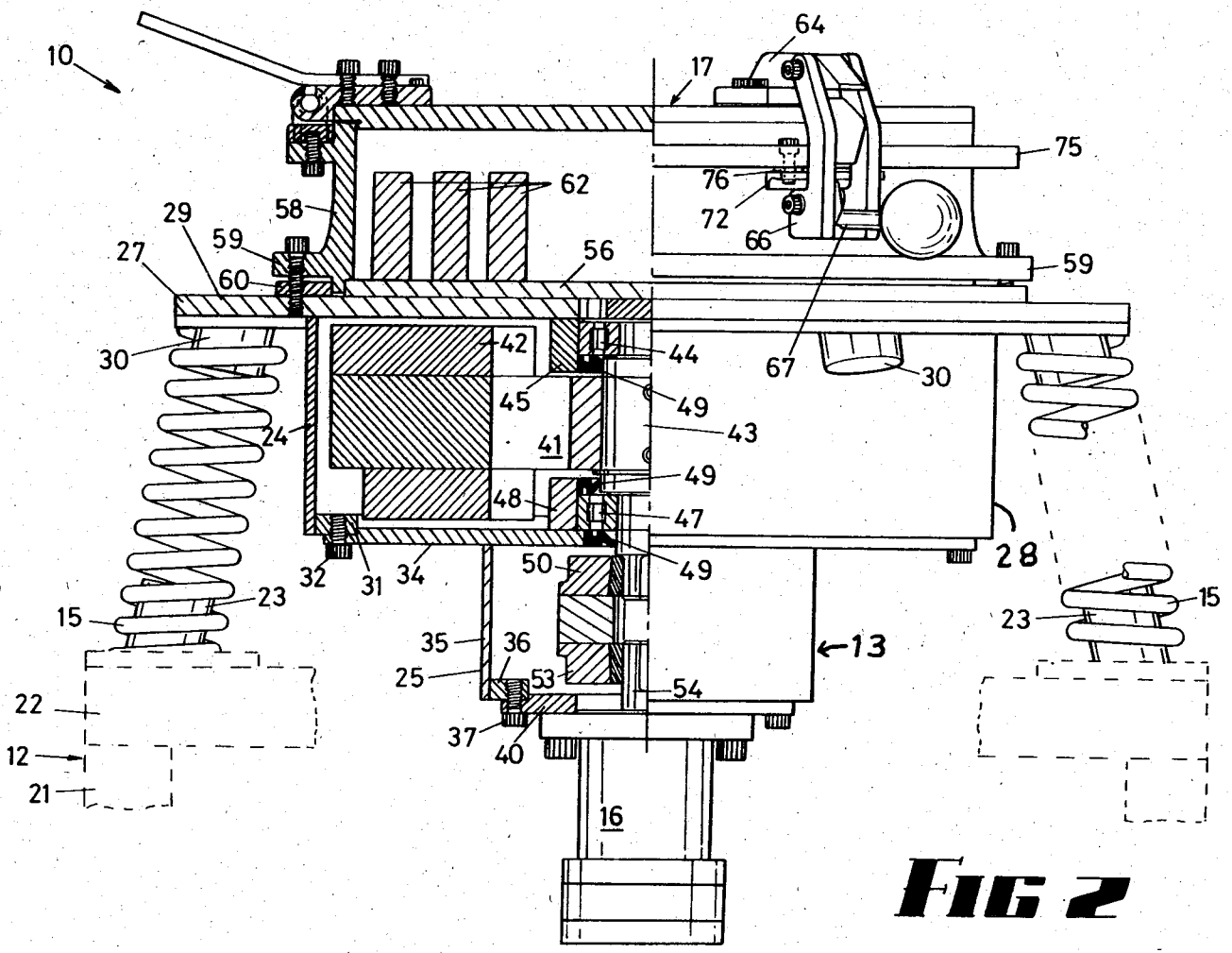
Figure 3:
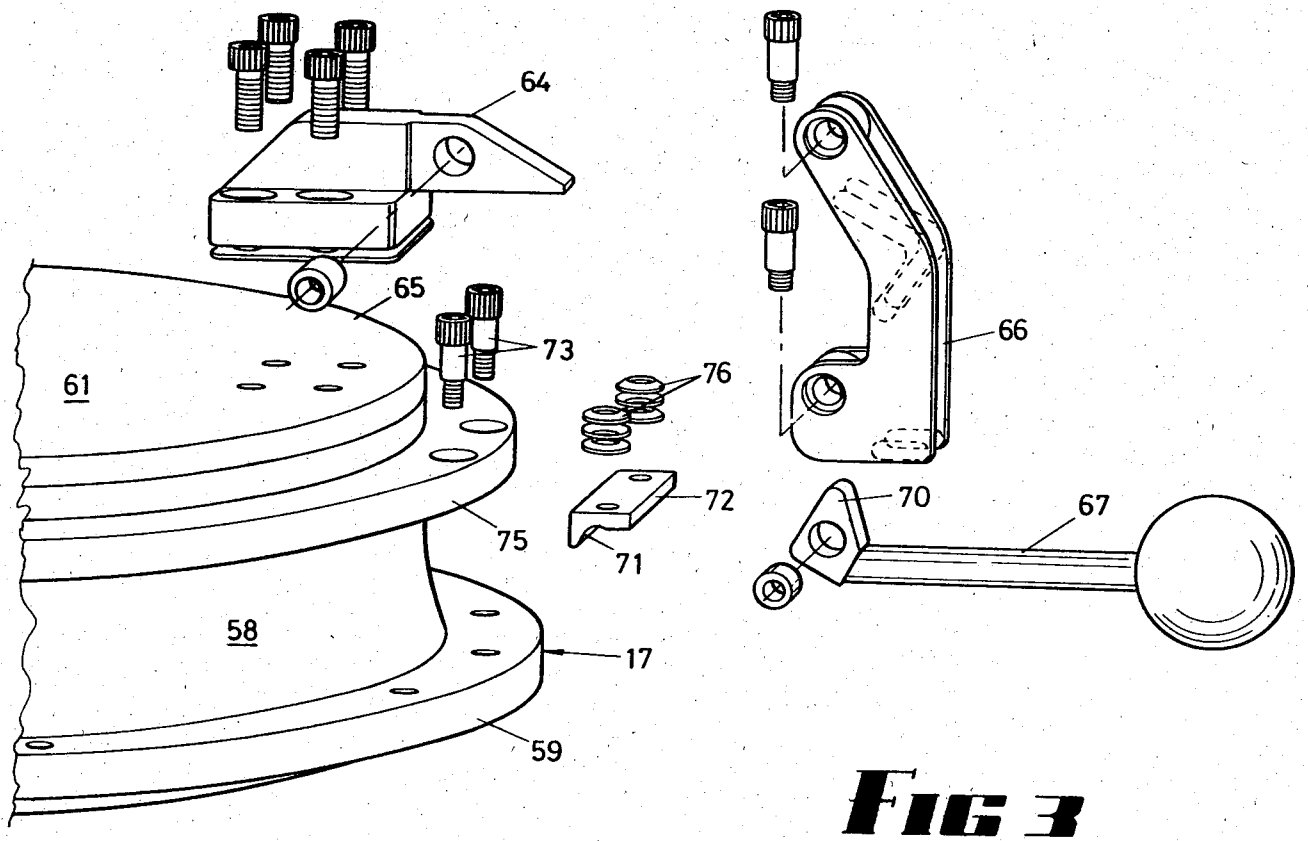

In order to more fully explain the present invention, an embodiment is described hereunder in further detail with reference to the accompanying drawings in which:

FIG. 1 is a perspective view of a pulverising mill housed in its cabinet according to this embodiment, FIG. 2 is a half vertical sectional view of the mill according to this embodiment, and FIG. 3 is an "exploded" perspective view of the clamping mechanism on the pulveriser bowl.

In this embodiment, a pulveriser mill 10 comprises a cabinet 11 in which is enclosed a fixed base frame 12, as vibrating frame 13 suspended for vibratory movement with respect to the base frame 12 by means of a plurality of support coil springs 15, and an hydraulic motor 16 attached to the lower end of the vibrating frame 13. The cabinet 11 rests on the ground and is secured to the base frame 12. A pulveriser container or bowl 17 is removably fastened on top of the vibrating frame 13 and projects through the upper surface 19 of the cabinet 11. A tiltable canopy 20 is pivotally mounted to the top of the cabinet 11 and is arranged to enclose the bowl 17 during the operation of the mill 10.

The base frame 12 comprises steel frame members 21 and an annular frame member 22 surrounding the vibrating frame 13 near its lower end. The upper surface of the member 22 has welded thereto a series of circumferentially spaced upstanding spigots 23, each of which locates a lower end of a respective spring 15 which encircles the spigot 23.

The vibrating frame 13 comprises an upper cylindrical housing 24, and a lower cylindrical housing 25 removably secured thereto. The upper housing 24 comprises an horizontal circular top flange 27 which closes off the upper end of the housing 24 and a depending annulus 28, the outer periphery of the flange 27 projecting radially beyond the periphery of the annulus 28. The circumferentially spaced springs 15 resiliently support the vibrating frame 13 from the base frame 12, by being interposed between the radially projecting flange portion 29 of the flange 27 and the annular base frame member 22, the upper ends of the springs 15 being retained in position by depending spigots 30 on the underside of the flange portion 9.

The lower end of the annulus 28 terminates in an horizontal inturned flange 31 to which is secured by screws 32, a circular closure plate 34 on the lower housing 25 which also comprises a depending cylindrical side wall 35 secured, by welding, at its upper end to the closure plate 34. The side wall 35 also terminates at its lower end in an inturned flange 36 to which is removably secured, by screws 37, a motor mounting plate 40 for mounting the hydraulic motor 16 thereto, the motor 16 depending vertically from the mounting plate 40.

The upper housing annulus 28 defines a space within which there moves an eccentrically loaded arm or disc 41 carrying an eccentric weight 42, the arm 41 being secured, e.g. by keying, to a vertical shaft 43 which extends centrally through the vibrating frame 13. The shaft 43 is journalled for rotation in bearings, in this embodiment being an upper roller bearing 44 contained in a depending hollow boss 45 located centrally on the flange 27 of the upper housing 24, and a lower roller bearing 47 also similarly contained in a depending boss 48 which depends from the closure plate 34. Seals 49 protect the bearing 44, 47 against the ingress of dust and the like. The upper bearing 44 is housed in the upper housing 24 and rotatably supports the upper end of the shaft 43 whilst the bearing 47 is housed within the lower housing 25 and supports an intermediate portion thereof.

The lower end of the shaft 43 terminates in one element 50 of a two-part flexible coupling 52, while the other element 53 is secured to the driving shaft 54 of the hydraulic motor 16. The coupling 52 in this embodiment is a known coupling sold under the proprietary name of "Fenner". The respective shaft ends are simply push-fitted into the open ends of the coupling 52.

The container or bowl 17 comprises a replaceable flat wear base plate 56 and a cylindrical side wall 58, all formed from a hard or hardenable steel, the side wall 58 being provided with an outstanding annular lower flange 59 which is bolted in face-to-face relation to an annular ring 60 welded to the upper surface of the upper housing top flange 27. The container 17 is centrally mounted on the vibrating frame 13 and has its wear base plate 56 in contiguous relationship with the flange 27. The container 17 is also topped by a hinged lid 61 in accordance with known art, the lid 61 being machined to have a shallow spigot which sealably engages around the inner periphery of the side wall 58 near its upper end. The bowl 17 contains three pulverising rings 62, the inner one of which is placed inside the middle one, which in turn is placed within the outer one, the rings 62 being freely movable over the container base 56 by a sliding action.

The lid 61 is releasably clamped to the container side wall 58 by means of a clamping mechanism 62 which comprises a cast bracket 64 bolted to the top of the lid 61 in proximity to its peripheral edge 65, a pivotal link 66 pivotally connected at its upper end to the bracket 64, and a pivoted clamp arm 67 pivotally attached to its inner end to the lower end of the link 66. The inner end of the arm 67 carries a cam member 70 which co-operates with and engages a cam surface 71 formed on a load plate 72 which is fastened by screws 73 to the underside of an upper annular flange 75 on the bowl side wall 58. A series of discoid spring washers 76 laid one on top of the other are interposed between the load plate 72 and the flange 75, such an arrangement being effective to allow some "give" in the mechanism when in its clamped position and thereby minimise wearing of the parts, in particular the load plate 72. When in the clamped position, the arm 67 moves to an "over-centre" position.

In this embodiment, the vibrating frame 13 is supported by eight coil springs 15 spaced there-around, each of the springs 15 being formed of approximately 7 mm diameter steel wire to have 17 turns and an axial length of 200 mm. Each spring 15 is inclined with respect to the vertical, preferably at an angle of 15°.

In use, sufficient geological material is placed into the container 17 so that, upon pulverisation, an homogeneous mixture can be obtained. The lid 61 is closed and clamped, and the hydraulic motor 16 is driven at a speed, preferably in the order of 700 rpm. to thereby vibrate the vibrating frame 13, the rings 62 in turn being impacted against one another to produce a grinding action for pulverising the geological sample. The vibratory movement agitates the sample placed in the container and such agitation causes it to migrate from the central region of the container in a radially outward direction, for pulverising by the two outside rings 62. In practice, the depth of the inner ring 62 is less than that of the two outside rings to facilitate the migration of the sample from within the inner ring to the outside rings. The sample so pulverised will be in sufficient quantity that it is respresentative of the mineral content, and an homogeneous mixture of particulate material can be removed from the container for analysis purposes.

The grinding action produced is such that wear is confined essentially to the base of the bowl 17, and the rings 62. By having the base plate 56 removably located in the bowl, one is able to readily replace it at a relatively low cost in comparison with some prior art pulverises where the whole grinding bowl is required to be replaced.

A brief consideration of the above embodiment will indicate that the invention provides an improved pulverising mill which is of simple design, contains relatively few moving parts and which can be readily repaired or serviced if need be.

I claim:

1. A pulverising mill comprising;

a fixed base frame, a vibrating frame comprising an upper cylindrical housing defining an eccentric weight housing chamber, support coil springs interocnnecting said base frame and said vibrating frame for resiliently supporting the frame, a pair of vertically spaced aligned bearing means carried in the vibrating frame, a vertical, driven shaft having its upper end and an intermediate portion thereof respectively journalled in said bearing means, said shaft extending centrally through said vibrating frame, an eccentric weight housed within said weight housing chamber and carried by said shaft for rotation therewith, said weight being secured to the shaft between said pair of spaced bearing means, a pulveriser bowl centrally supported on said upper cylindrical housing of said vibratory frame for vibratory movement therewith and in proximity to said eccentric weight so that, during use of the mill, tilting of said pulveriser bowl is substantially eliminated, said pulveriser bowl having a removable base wear plate, and an hydraulic motor attached to said vibrating frame and having its drive shaft coupled by flexible coupling means to the lower end of said driven shaft.

2. A pulverising mill according to claim 1 wherein said vibrating frame further comprises a coaxial lower cylindrical housing of smaller diameter than said upper housing and removably attached thereto, said upper housing housing said eccentric weight and said bearing means, said lower housing defining a chamber which houses said flexible coupling means.

3. A pulverising mill according to claim 2 wherein said lower housing comprises a cylindrical side wall which terminates at its lower end in an inturned horizontal flange to which is removably attached an horizontal mounting plate to which in turn is removably bolted said hydraulic motor.

4. A pulverising mill according to claim 2 wherein said upper housing comprises a depending annulus, an upper flat circular flange secured to said annulus so as to close off its upper end, the periphery of said flange projecting radially beyond the periphery of said annulus, and there is provided means for removably fastening said pulveriser bowl to said flange.

5. A pulverising mill according to claim 4 wherein the underside of said removable base wear plate is contiguous with the upper surface of said upper flange of the upper housing.

6. A pulverising mill according to claim 1 or claim 5 wherein said bowl comprises an annular flange outstanding from the side wall of said bowl adjacent its upper end, a lid hingedly mounted to the bowl and arranged to sealably close the open upper end thereof, and further comprising releasable clamp means carried by said lid being co-operable with clamp engagement means fastened to the underside surface of said outstanding flange for releasably clamping said lid in its closed position.

7. A pulverising mill according to claim 6 wherein said clamp engagement means comprises a load plate, and spring washer means interposed between the upper surface of said plate and the undersurface of said outstanding flange.

8. A pulverising mill according to claim 7 wherein said clamping means comprises a fixed bracket on the upper surface of said lid in proximity to its periphery, a swinging link pivotally connected at its upper end to said bracket for swinging movement in a vertical plane, and a clamp arm pivotally attached to the lower end of said link also for swinging movement in a vertical plane, said clamp arm having at its inner end a cam member which, upon downward swinging movement of the clamp arm, engages a cam surface on the lower surface of said load plate to thereby move the load plate into pressure contact with the underside surface of said outstanding flange.

9. A pulverising mill according to claim 8 wherein said clamp arm assumes an "over-centre" position when in its fully clamped position.

10. The pulverising mill according to claim 4 wherein said fastening means also secures said removable base wear plate to said flange.

11. A pulverising mill according to claim 1 wherein said upper cylindrical housing, comprises a depending annulus, an upper flat circular flange secured to said annulus so as to close off its upper end, the periphery of said flange projecting radially beyond the periphery of said annulus, and there is provided means for removably fastening said pulveriser bowl to said flange.

* * * * *